US005964015A

United States Patent [19]

Sear

[11] Patent Number: 5,964,015

[45] Date of Patent: Oct. 12, 1999

[54] TEXTILE JET NOZZLE WITH SMOOTH YARN CHANNEL

[75] Inventor: Nicolas C Sear, Winston-Salem, N.C.

[73] Assignee: International Machinery Sales, Inc., Winston-Salem, N.C.

[21] Appl. No.: 09/316,573

[22] Filed: May 21, 1999

[51] Int. Cl.[6] ..... D02J 1/08

[52] U.S. Cl. ..... 28/274

[58] Field of Search ..... 28/271, 272, 274, 28/273, 275, 276, 258, 220

[56] References Cited

U.S. PATENT DOCUMENTS

| | | | |
|---|---|---|---|
| 4,345,425 | 8/1982 | Negishi et al. | 57/289 |
| 4,355,445 | 10/1982 | Matsumoto et al. | 28/274 |
| 4,644,620 | 2/1987 | Maeda | 28/220 |
| 4,679,284 | 7/1987 | Naylor et al. . | |
| 4,878,280 | 11/1989 | Nelson et al. | 28/274 |
| 4,949,441 | 8/1990 | Ethridge | 28/271 |
| 5,010,631 | 4/1991 | Ritter . | |
| 5,146,660 | 9/1992 | Ritter . | |
| 5,157,819 | 10/1992 | Hodan | 28/271 |
| 5,713,113 | 2/1998 | Demir | 28/274 |

*Primary Examiner*—Amy Vanatta
*Attorney, Agent, or Firm*—Robert W. Pitts

[57] ABSTRACT

A textile yarn interlacing or intermingling jet nozzle 2 has a yarn channel 4, a threading slot 6 and an air inlet 8. The yarn channel 4 is formed between a top plate 40 mounted to a base 20 by bolts 70, 80 which secure both members to a nozzle support 90 to form the nozzle assembly. The threading slot 6 extends from one side and opens into the yarn channel so that a multifilament yarn can be inserted from the side. This threading slot 6 is formed by the lower surface 48 of a lip 46 on the top plate 40 and an upper surface 24 on the base. To insure that the sidewall 10 of the yarn channel through which the threading slot extends does not contain any sharp edges that could damage yarn, shoulders 34 and 42 are formed on the base 20 and top plate 40. When these shoulders abut, the upper and lower surfaces forming sidewall 10 are in the same plane and there are no offset or exposed edges to damage the yarn. The shoulders 34 and 42 are brought into abutment as a bolt 70 mounts the top plate 40 to the base 20. A camming sleeve 60, surrounding the bolt 70, has an inclined camming surface 62 which engages an opposed camming surface 54 on the upper surface of the top plate 40 to shift the top plate laterally until the shoulders abut.

20 Claims, 4 Drawing Sheets

Fig. 6
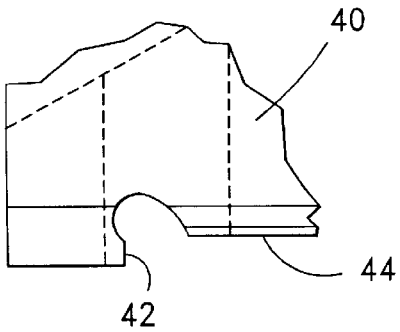
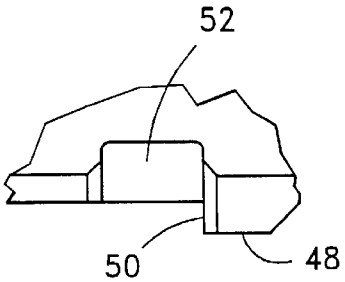
Fig. 7
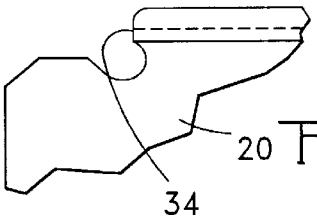
Fig. 8
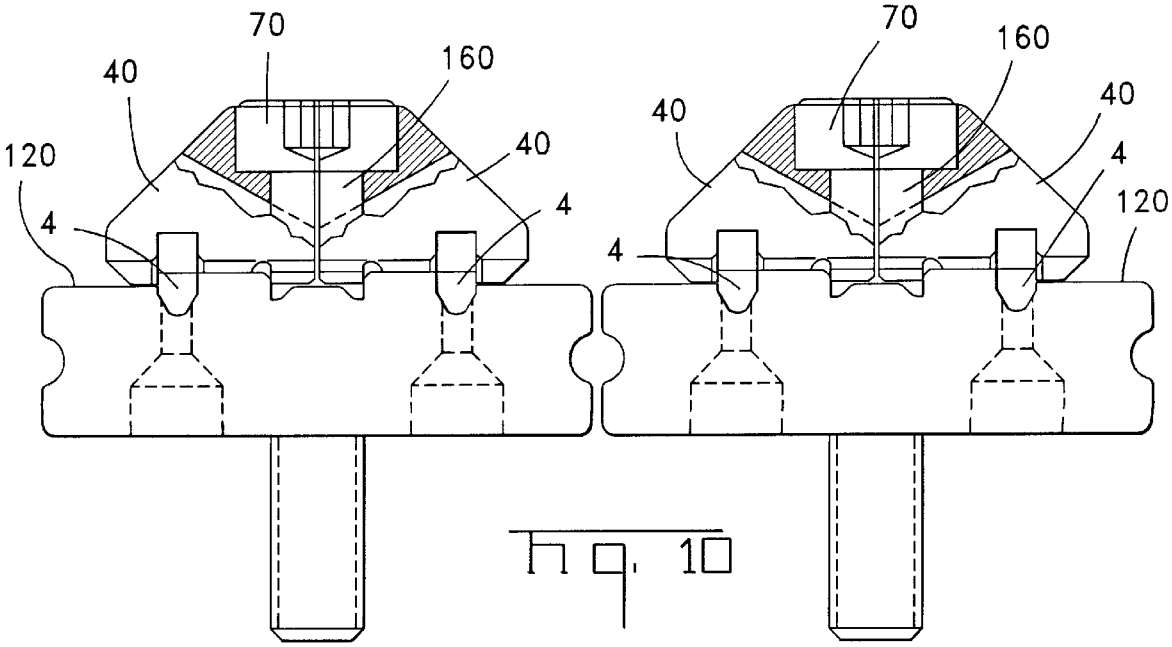
Fig. 10

TEXTILE JET NOZZLE WITH SMOOTH YARN CHANNEL

BACKGROUND OF THE INVENTION

1. Field of the Invention

This invention is related to interlacing jets and jet nozzles that are used with multifilament textile yarns. More particularly this invention is related to two piece nozzles in which a top and bottom section are assembled to form a yarn channel.

2. Description of the Prior Art

U.S. Pat. No. 4,679,284 discloses a yarn processing air jet in which a yarn channel and a threading slot are formed by upper and lower parts that are held together by bolts. The lower part defines the lower portion of the yarn channel and one wall of the yarn channel below the threading slot. The upper part forms the top of the yarn channel and the portion of one wall above the threading slot. The yarn channel wall opposite the threading slot is formed by the lower part which abuts the upper part at the top of the yarn channel. The cross section of the yarn channel is triangular the yarn channel diverges from an air inlet toward the yarn channel outlet.

U.S. Pat. Nos. 5,010,631 and 5,146,660 disclose two piece textile jets with a continuous yarn channel for intermingling or interlacing multifilament yarns. The yarn channels in each of these patents are formed by a lower nozzle section including an air inlet and an upper baffle section, opposed to the air inlet. Each device also has a threading slot extending into one side of the yarn channel. The edge of the baffle section adjacent to the threading slot is offset relative to the portion of the bottom of the yarn channel adjacent to the threading slot. The purpose of this offset is to prevent the air stream deflecting off the baffle section from tending to entrain or force the yarn filaments out of the threading slot. However, it is believed that in practice this exposed edge tends to damage or abrade the yarn filaments. It is therefore desireable that the edge of the top section be in alignment with the adjacent edge of the bottom section so that the top edge does not protrude or extend into the yarn channel beyond the adjacent the bottom edge. However, this requires substantially precise alignment which needs to be assured and repeatable in a production environment. The instant invention provides such assurance, and two piece jet nozzles can be easily assembled so that the set up time for multiple jet nozzles is minimized.

SUMMARY OF THE INVENTION

In accordance with this invention, a jet, for interlacing multifilament textile yarn, comprises a base and a top plate. When assembled, the base and top plate form a yarn channel and a threading slot. The yarn channel has parallel opposed side walls and a lower convex surface formed in the base and an upper surface formed by the top plate. The base includes a side face forming a portion of one yarn channel side wall below the threading slot. The top plate includes a lip having a side face forming a portion of the one yarn channel side wall above the threading slot. The base has a first shoulder spaced from the yarn channel and the top plate has a second shoulder spaced from the yarn channel. When the top plate is assembled to the base, the first and second shoulders abut so that the side face of the lip, above the threading slot, is in the same plane as the side face of the base below the threading slot. Coplanarity of the surfaces above and below the threading slot prevent damage to the yarn by exposed edges adjacent the threading slot.

Furthermore according to this invention, a jet nozzle for treating textile yarns comprises a base and a top plate attachable to the base to form a yarn channel, extending between opposite ends of the nozzle, between the base and the top plate. The base includes an air inlet communicating with the yarn channel. The base has a first top surface and a second top surface on opposite sides of the yarn channel. The second top surface is offset relative to the first top surface. A first shoulder on the base extends from the first top surface and spaced from the yarn channel. A second shoulder on the top plate is also spaced from the yarn channel, and the first and second shoulders abut when the top plate is mounted on the base. A lip on the top plate is spaced from the second top surface to form a threading slot between the lip and the base. The lip is spaced from the second shoulder by a distance equal to the spacing between the first shoulder and a base side wall below the threading slot, so that the lip and the base side wall form a yarn channel surface without protruding edges when the top plate is mounted on the base. A cam surface is configured so that a force on the cam surface moves the second shoulder into abutment with the first shoulder.

BRIEF DESCRIPTION OF THE DRAWINGS

FIG. 6 is a fragmentary side view showing an alignment shoulder on the top plate.

FIG. 7 is a fragmentary side view showing the lip on the top plate.

FIG. 8 is a fragmentary side view showing the alignment shoulder on the base, which abuts the alignment shoulder on the top plate when the top plate is mounted on the base.

FIG. 10 is a view of two assemblies as shown in FIG. 9 in which the two bases can mounted side by side.

DETAILED DESCRIPTION OF THE PREFERRED EMBODIMENTS

Figure 1:
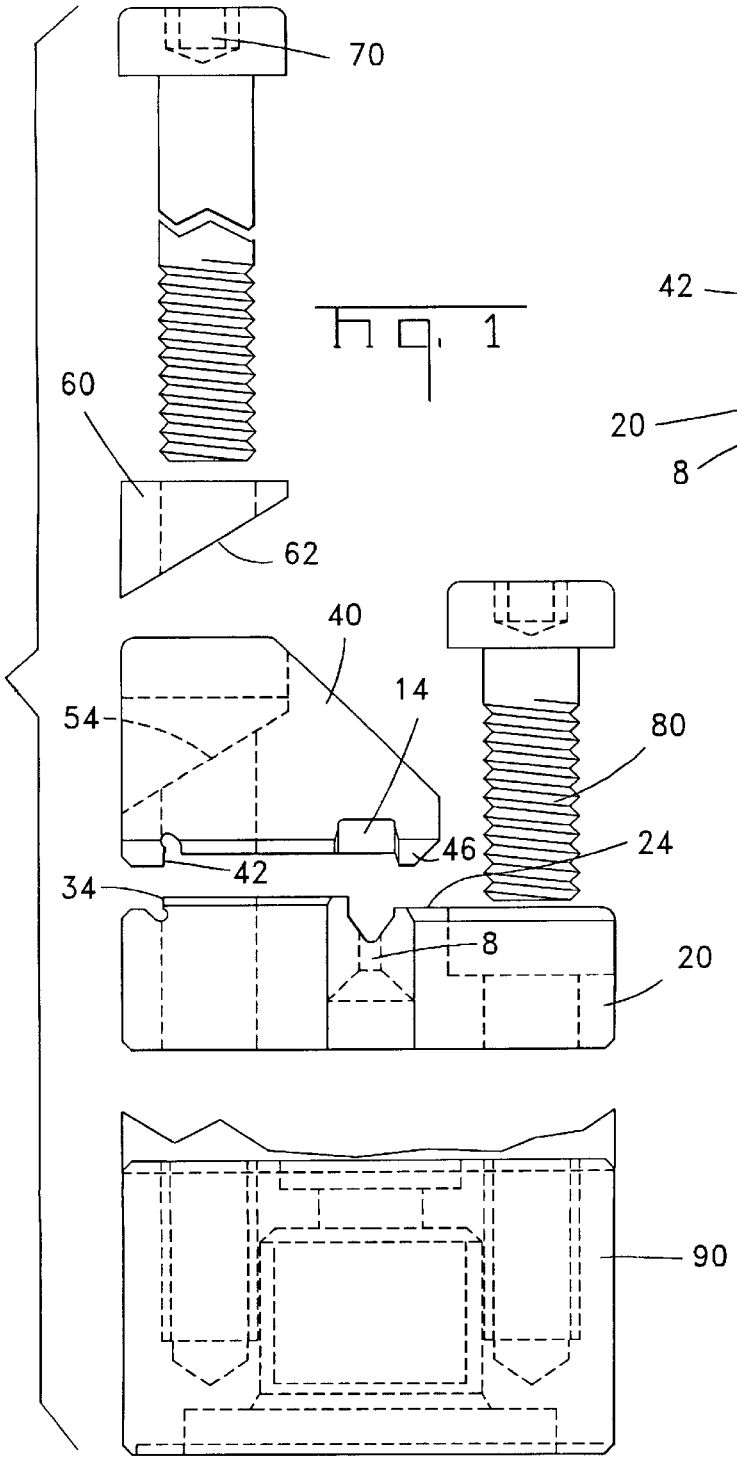
FIG. 1 is an exploded view of a two piece jet nozzle showing the manner in which a base and top plate are to be assembled.

The preferred embodiments of the present invention comprise means for interlacing multifilament textile yarns as the yarns are drawn through a nozzle 2. A yarn channel 4 extends between opposite ends of the yarn channel and a threading slot 6 enters one side of the yarn channel 4 to permit yarn to be laced into the yarn channel. An air inlet 8 communicates with the yarn channel 4 between its ends. A source of high pressure air injects air into the yarn channel 4 as multifilament yarn is drawn between the entrance and the exit of the yarn channel. The resulting turbulence results in interlacing or intermingling the yarn filaments.

The yarn channel 4 and the treading slot 6 are formed between a base 20 and a top plate 40, both of which are attached to a support 90 by a camming bolt 70 and a mounting bolt 80. Surfaces on the base 40 form a lower convex surface of the yarn channel 4 and one channel side wall 12. A side face 26 forms the portion of the other or remote side wall 10 that extends below the threading slot 6. The top of the yarn channel 4 and the portion of the first side wall 10 above the threading slot 10 are formed by the top plate 40. Both the base 20 and the top plate 40 are formed from a ceramic material such as a micro grain alumina ceramic having a grain size of 2–7 microns. It should be understood however that both the base 20 and the top plate 40 could be machined from a metal or fabricated from equivalent materials known to those skilled in the art.

The base 20 is generally rectangular in shape and has two flat top surfaces 22 and 24 on opposite sides of the yarn channel 4. The plane of the first top surface 22 is spaced above the plane of the second top surface 24 so that the second top surface, on the threading slot side of the yarn channel 4 is offset relative to the top surface 24 on the closed side of the yarn channel 4. In the preferred embodiment, these surfaces 22 and 24 are parallel, although the surface 24 could be inclined to provide a wider entrance to the threading slot 6.

Figure 4:
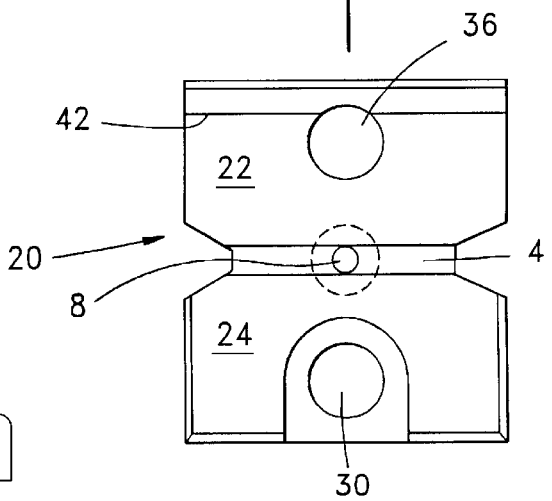
FIG. 4 is a top plan view of the base showing the bottom of the yarn channel and the position of an aligning shoulder and an hole for receiving a mounting bolt.
Figure 5:
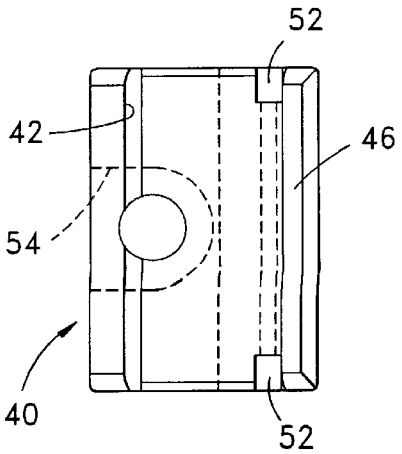
FIG. 5 is a view of the bottom surface of the top plate showing the side edge of a lip which forms on yarn channel side wall.

As shown in FIG. 4, the lower portion of the yarn channel 4 comprises a channel or recess in the top of the base 20 extending between opposite ends of the base 20, and therefore the nozzle 2. Lead in sections are of course provided on the ends of the base 20. The channel forming the lower portion of the yarn channel 4 separates the first base flat top surface 22 from the second base flat top surface 24. Two bolt holes 36 and 38 extend between the top a bottom surfaces of the base 20. A recess forms a base alignment shoulder 34 at one side of the top surface section 22. The inwardly facing surface of shoulder 34 extends between opposite ends of the base 20 and is spaced from the yarn channel 4. This alignment shoulder 34 will engage a corresponding surface on the top plate 40 when assembled to the base to form a means for precisely positioning the top plate 40 and the top plate lip 46 relative to the lower portion of the yarn channel 4 formed in the base 20. The groove at the base of the shoulder 34, between the shoulder and the base top surface 22 eliminates a sharp corner and thus eliminates or reduces stress concentrations.

Figure 2:
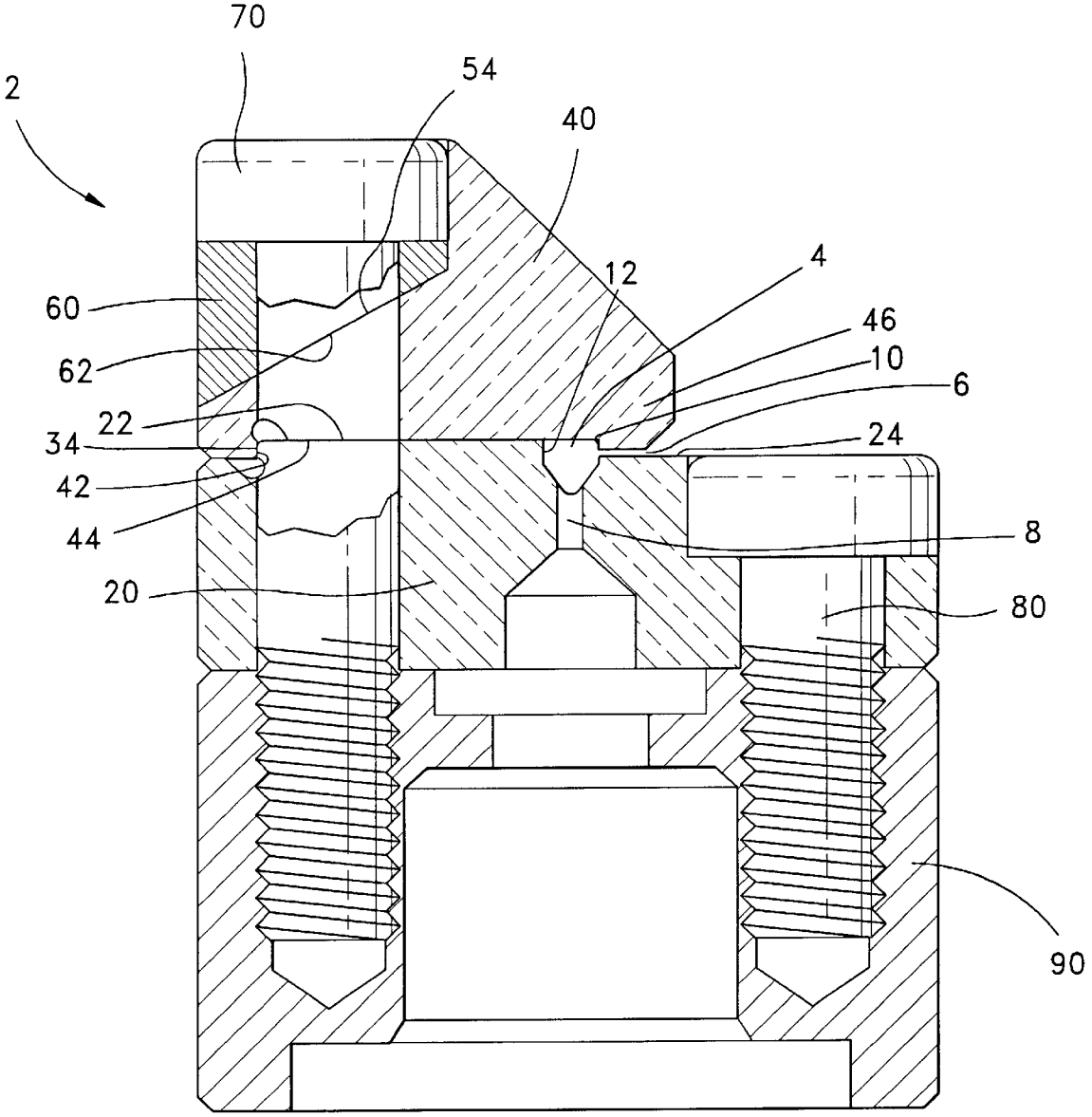
FIG. 2 is a section view of the assembled components of the two piece nozzle.

Although referred to herein as top plate 40, the upper portion of the nozzle 2 and the yarn channel 4 is formed by a block which has a thickness greater than that of the base 20 and which a generally trapezoidal section when viewed from the side as shown in FIG. 1. Except as otherwise discussed herein, the overall shape of the top plate 40 is not critical to the operation of nozzle 2. The top plate 40 has a width that is somewhat more than half the width of the base 20 and includes a flat lower surface 44 that extends between a top plate alignment shoulder 42 along one side and a lip 46 along the other side. Both the alignment shoulder 42 and the lip 46 project beyond the flat lower surface 44. The lip 46 and the portion of the lower surface 44 form portions of the yarn channel 4. The top plate lower surface 44 forms the top of the yarn channel 4, extending between the yarn channel sidewalls 10 and 12. The lip 46 has a side face 50 and a lower face 48 which extend between opposite ends of the top plate 40 with beveled ends 52 located at the entrance and the exit of the yarn channel 4. The side face 50 of lip 46 forms the portion of the yarn channel side wall 10 extending above the threading slot 6. The lower face 48 of the lip 46 forms the top of the threading slot 6 and is spaced from the base top surface 24, which forms the bottom of threading slot 6. The projecting alignment shoulder 42 is spaced from the yarn channel 6 and from the lip 46. When the top plate 40 is mounted on top of the base 20, the top plate alignment shoulder 42 engages the base alignment shoulder 34 to position the lip side face 50 in substantially the same plane as the base side face 26 extending below the threading slot 6. Therefore there will be no protruding comers either above or below the threading slot to fray, abrade or damage the yarn filaments as they are move about under the influence of high pressure air introduced into the yarn channel 4 though the inlet 8. The interlaced or intermingled yarn should therefore be of higher quality. The projecting top plate alignment shoulder 42 is shown in detail in FIG. 6 and its engagement with the recessed base alignment shoulder 34 as shown in FIG. 2. Although top plate shoulder 42 is a projects from the bottom of the top plate 40 and the base alignment shoulder 34 is recessed relative to the base upper surface, it should be understood that this relationship could be reversed. As shown in FIG. 6, a stress reducing groove is also formed between the top plate aligning shoulder 42 and the top plate lower surface 44 to prevent stress concentration.

The base 20 and the top plate 40 are assembled and held together by a bolt 70 which extends through a bore hole in both members and secures them to a support 90. Bolt 70 is not threaded to either of these two members but the head of this bolt 70 clamps the top plate 40 to the base 20 and both members are then held in place by the engagement of the threads to the support 90. The base 20 is also held in place by a second bolt 80 which does not engage the top plate 40. The bolt 70 also serves as a camming bolt. A camming sleeve or camming washer 60, which comprises a cylindrical or tubular member having one inclined face 62 is mounted on the camming bolt 70, between the head of this bolt and the top plate 40. An inclined camming surface 54 surrounds the bore hole on the top plate 40. As the camming bolt 70 is tightened, the inclined surface 62 on the camming sleeve 60 engages the inclined camming surface 54 on the top plate 40 and causes the top plate 40 to shift laterally toward the yarn channel 4. This lateral movement brings the top plate alinement shoulder 42 into engagement with the base alignment shoulder 54. Since both of the alignment shoulders are precisely positioned relative to the yarn channel, the side face 50 of lip 46 will be in the same plane as the base side face 28 below the threading slot 6 when the bolt is full tight. In this way precise alignment is insured between the two faces of channel wall 10 which extend above and below the threading slot 6.

Figure 3:
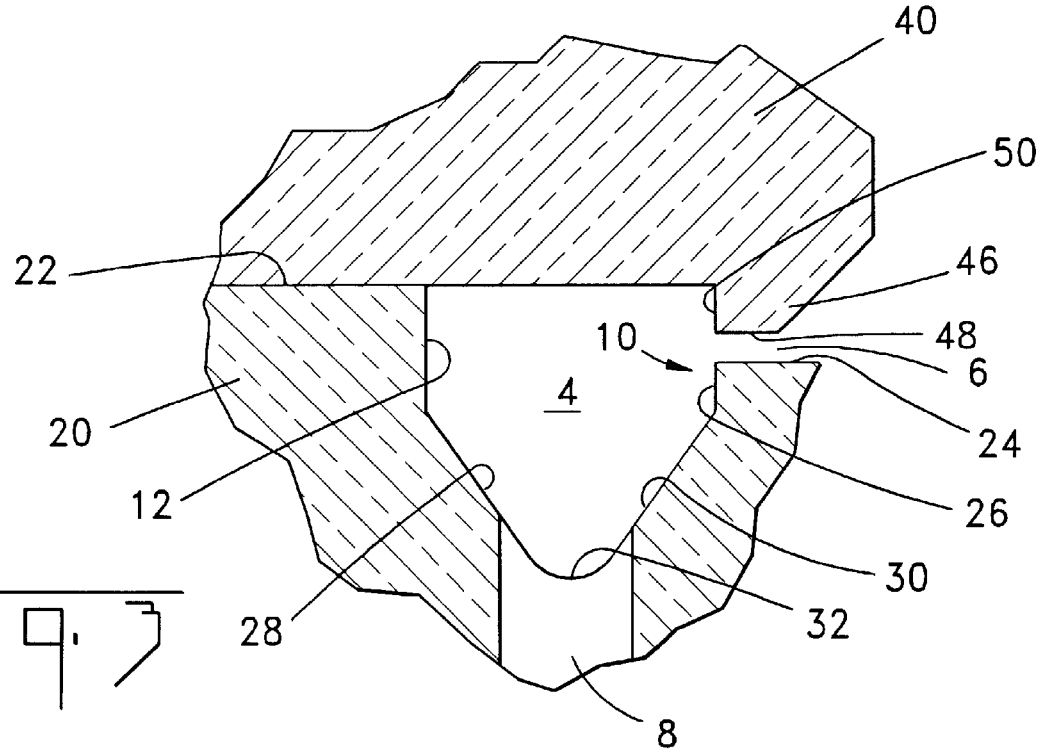
FIG. 3 is a section view showing the contour of the yarn channel.

The exploded view in FIG. 1 and the section view of FIG. 2 show the manner in which the top plate 40 and the base 20 are assembled to the support 20. The base 20 can first be attached to the support 90 by the mounting bolt 80. The opening for the camming bolt 70 must be in line with the corresponding threaded hole in the support plate. The camming sleeve 60 is positioned between the top plate 40 and the head of the camming bolt 70. The camming bolt is then inserted through a top plate hole that is aligned with corresponding holes in the base 40 and the support 90. As the camming bolt 70 is tightened, the camming surface 62 on the camming sleeve 60 can slip relative to the opposed camming surface 54 on the top plate 40. Before the camming bolt 70 if full tight, the top plate will then move, due to this force exerted by sleeve 60 on top plate 40. The top plate 40 moves until the shoulder 42 abuts the shoulder 34. When these two shoulders are in abutment, the lip face 50 on the top plate 40 will be in the same plane as the base side face 26 below the threading slot 6. The yarn channel side 10 will then be formed by two coplanar surfaces 50 and 26, because of the fixed distances between each of these surfaces and the alignment shoulders on the top plate 40 and the base 20 respectively. Of course this coplanarity will be within conventional tolerances for ceramic components, but there will be no tolerance stackups to increase the offset between the two surfaces forming side wall 10. FIG. 3 shows these two coplanar surfaces 50 and 26 and the fact that there will be no offset or protruding edges or shoulders on either side of the threading slot to damage the yarn threads as they twist in the air jet from air inlet 8.

Figure 9:
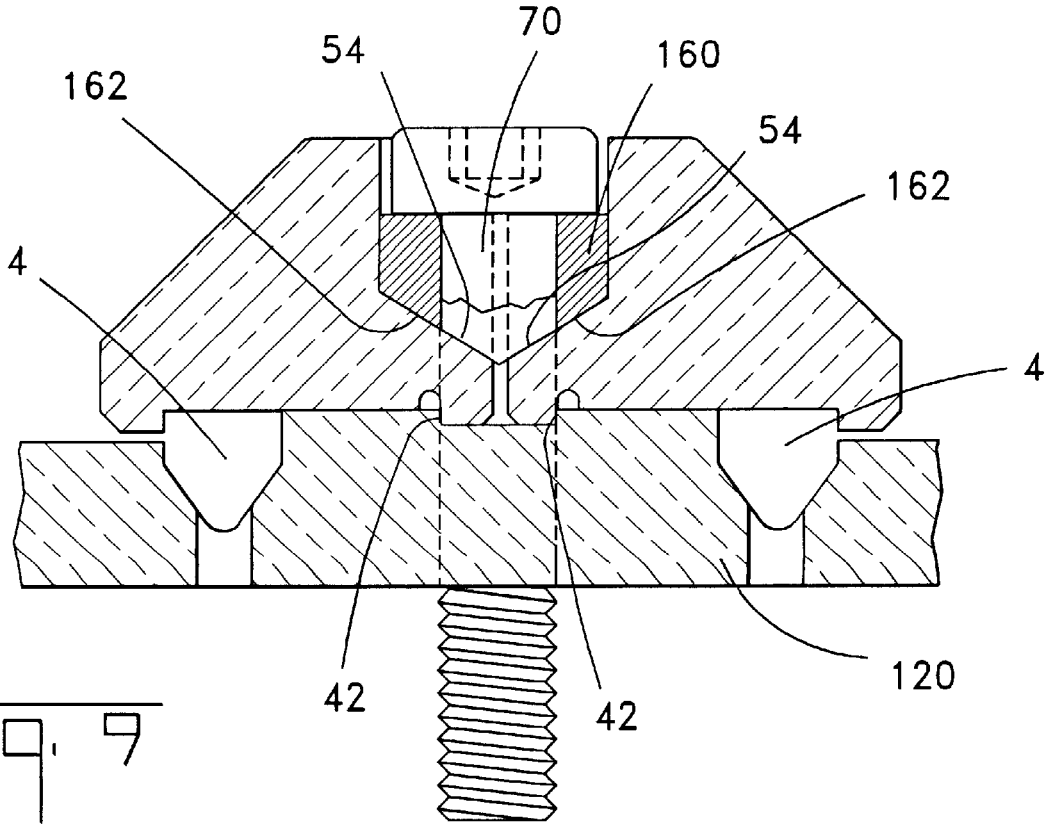
FIG. 9 is a view of a jet with a single bolt and camming member aligning separate top plates for two side by side yarn channels.

FIG. 9 shows an additional embodiment of a jet assembly in which two yarn channels 4 are formed in the base member 120, and two separate top plates 40 are assembled to the same base 120 and underlying support (not shown) by a single camming screw 70. A double beveled or inclined camming sleeve 160 surrounds the camming bolt 70 and two sleeve camming surfaces 162 engage camming surfaces 54. The two top plates 40 are forced in opposite directions as the bolt 70 is tightened until the shoulders 42 on each top plate 40 engage corresponding alignment shoulders on the base 120 in the same manner as for the embodiment of FIGS. 1–8. FIG. 10 shows the manner in which two of the assemblies shown in FIG. 9 can be mounted side by side to form a bank of nozzles.

The preferred embodiments of the invention depicted herein are representative of the invention and do not represent the only way in which one of ordinary skill in the art could employ this invention. For example, instead of forming continuous alignment shoulders on the base and top plate, it would also be possible to form local alignment sections or bumps that would abut in substantially the same manner as a continuous shoulder. Other equivalent changes could be made to the shape of the base and top plate without departing from the invention as defined in the following claims.

I claim:

1. A jet for interlacing multifilament textile yarn comprising a base and a top plate forming a yarn channel and a threading slot, the yarn channel having parallel opposed side walls and having a lower convex surface formed in the base and an upper surface formed by the top plate, the base including a side face forming a portion of one yarn channel side wall below the threading slot, the top plate including a lip having a side face forming a portion of the one yarn channel side wall above the threading slot, the base having a first shoulder spaced from the yarn channel and the top plate having a second shoulder spaced from the yarn channel, the first and second shoulders abutting so that the side face of the lip above the threading slot is in the same plane as the side face of the base below the threading slot to prevent damage to the yarn by exposed edges adjacent the threading slot.

2. The jet of claim 1 wherein the base includes a side face forming a second yarn channel side wall parallel to the side wall through which the threading slot extends.

3. The jet of claim 1 wherein the lower convex surface of the yarn channel is formed by faces forming a V-shape with a radiused intersection.

4. The jet of claim 1 wherein an air inlet extends though the base and intersects the yarn channel.

5. The jet of claim 4 wherein the air inlet extends transverse to a lower surface of the top plate.

6. The jet of claim 1 wherein the air inlet extends perpendicular to the lower surface of the top plate.

7. The jet of claim 1 wherein the top plate and the bottom plate comprise machined form a micro grain alumina ceramic having a grain size between 2 and 7 microns.

8. The jet of claim 1 wherein the base has a flat upper surface and the top plate has a flat lower surface, the flat upper surface and the flat lower surface abutting when the top plate is assembled relative to the base to form the yarn channel, the first shoulder extending transversely relative to the base top surface and the second shoulder extending transversely relative to the top plate lower surface, the first shoulder and the second shoulder abutting when the top plate is assembled relative to the base to form the yarn channel.

9. The jet of claim 8 wherein the top plate includes a camming surface configured so that a force applied to the camming surface urges the second shoulder into engagement with the first shoulder so that the side face of the lip above the threading slot is in the same plane as the side face of the base below the threading slot.

10. The jet of claim 9 wherein a bolt is used to assembly the top plate to the base for forming the yarn channel, and wherein a camming sleeve is urged by the bolt into engagement with the camming surface on the top plate to force the second shoulder into abutment with the first shoulder.

11. A jet nozzle for treating textile yarns comprising a base and a top plate attachable to the base to form a yarn channel, extending between opposite ends of the nozzle, between the base and the top plate, the base including an air inlet communicating with the yarn channel, the base having a first top surface and a second top surface on opposite sides of the yarn channel, the second top surface being offset relative to the first top surface, a first shoulder on the base extending from the first top surface and spaced from the yarn channel, and a second shoulder on the top plate spaced from the yarn channel, the first and second shoulders being abutable when the top plate is mounted on the base, a lip on the top plate spaced from the second top surface to form a threading slot between the lip and the base, the lip being spaced from the second shoulder by a distance equal to the spacing between the first shoulder and a base side wall below the threading slot, so that the lip and the base side wall form a yarn channel surface without protruding edges when the top plate is mounted on the base, and a cam surface configured so that a force on the cam surface moves the second shoulder into abutment with the first shoulder.

12. The jet nozzle of claim 11 wherein the cam surface in on the top plate.

13. The jet nozzle of claim 12 wherein the cam surface comprises a surface inclined relative the first and second top surfaces when the top plate is mounted on the base.

14. The jet nozzle of claim 13 further including a cam member having an opposed inclined surface engagable with the inclined cam surface on the top plate when the top plate is mounted on the base.

15. The jet nozzle of claim 14 wherein the cam member comprises a cylindrical member mounted on a bolt, the bolt comprising means for securing the top plate to the base.

16. The jet nozzle of claim 15 wherein the base is mounted on a support and the bolt is fastened to the support.

17. The jet nozzle of claim 11 wherein the first shoulder forms a recessed section on one side of the first surface.

18. The jet nozzle of claim 17 wherein the second shoulder comprises a projection extending from a lower surface of the top plate.

19. The jet nozzle of claim 17 wherein the first shoulder extends between opposite ends of the base.

20. The jet nozzle of claim 11 wherein the lip extends between opposite ends of the top plate and includes beveled surfaces at opposite ends of the lip.

* * * * *